US006278366B1

(12) United States Patent
Fletcher et al.

(10) Patent No.: US 6,278,366 B1
(45) Date of Patent: Aug. 21, 2001

(54) ADAPTIVE SOUND ACTUATED ILLUMINATION DEVICE FOR BATTERY OPERATION

(76) Inventors: Mark W. Fletcher, 17131 Rainbow Ter., Odessa, FL (US) 33556; Stephen P. Taylor, 34501 Tranquilview La., Dade City, FL (US) 33523; W. W. Donnelly, Jr., 9240 Tara Dr., New Port Richey, FL (US) 34654

( * ) Notice: Subject to any disclaimer, the term of this patent is extended or adjusted under 35 U.S.C. 154(b) by 0 days.

(21) Appl. No.: 09/469,591

(22) Filed: Dec. 22, 1999

(51) Int. Cl.[7] ..... E05B 45/06

(52) U.S. Cl. ..... 340/542; 315/149; 362/100

(58) Field of Search ..... 315/149–159, 315/119, 292–296, 360, 362; 362/100, 802, 276, 383; 340/542, 545–549

(56) References Cited

U.S. PATENT DOCUMENTS 5,179,325 * 1/1993 Aragon, Jr. ..... 362/100
5,535,104 * 7/1996 Maffey et al. ..... 362/100
5,680,094 * 10/1997 Guim et al. ..... 340/542
5,712,615 * 1/1998 Maffey et al. ..... 340/542
6,078,256 * 6/2000 Gottlieb ..... 340/542

* cited by examiner

*Primary Examiner*—Don Wong
*Assistant Examiner*—Wilson Lee
(74) *Attorney, Agent, or Firm*—Louis J. Brunoforte

(57) ABSTRACT

An adaptive, battery-operated sound actuate illumination device includes a housing of a durable material having an interior chamber and electronic components located within the chamber. The housing utilizes existing door lock hardware to secure the device to the door for unobtrusive, mechanical installation. The electrical components include a light emitting device positioned within the housing adjacent to an area to be illuminated, a sound receiving sensor adapted to respond to a noise by the user and energize the light emitting device, an optical sensor adapted to determine the existence of ambient light and thereby preclude the illumination of the light device when light is detected, an integrated circuit to receive the inputs of the microphone and optical sensor and to provide an output to energize the light emitting device, a time sensing electrical component adjacent to the input end of the integrated circuit to time out the activation of the light emitting diode after a predetermined period of time and a power source to power the microphone, optical sensor, timing circuit, and light emitting diode.

6 Claims, 6 Drawing Sheets

ADAPTIVE SOUND ACTUATED ILLUMINATION DEVICE FOR BATTERY OPERATION

BACKGROUND AND FIELD OF THE INVENTION

The present invention relates to an illumination device that is sound actuated, and powered by batteries. Such a device would provide great utility and safety in aiding in the process of finding the proper key, the insertion of said key in the lock of a door of a residence at night. The present invention addresses that need. The preferred embodiment is an illumination device for door locks. Prior art indicates many door lock illumination devices, and many sound-actuated switches for control of illumination. However, no prior art teaches an illumination device, actuated by sound and optimized for outdoor use with ambient noise and light abatement, extended battery powered operation, and unobtrusive, adaptive, non-marring mounting flange for mechanical installation.

DESCRIPTION OF PRIOR ART

Sound actuated light switches and door lock illuminators are well known. However, no prior teachings depict the unique design features of the present invention that uses a collective combination of sensory and control circuits that act in concert to provide the performance and functional features and benefits described herein. The present invention combines the following in a unique, non-obvious way to provide some of the benefits and features of the present invention:

1. Inherently, low power and low cost electronic devices are used throughout the invention.

2. An electric condenser microphone is used as a sound sensor and is selected for low power operation, and limited frequency response.

3. The light source is high in energy-efficiency and low in cost

4. A sound actuation threshold adapts to the ambient noise level thus discriminates against unwanted noise.

5. A light sensor turns off the sound actuator and illuminator when ambient illumination is present.

6. A time delay circuit turns off the illuminator after a preset time interval.

7. A constant current circuit provides a fixed current through the illuminator, providing constant brightness as the battery voltage decreases.

The advantages of the new art as contrasted with prior art will become evident.

Patented door lock illuminator devices can be arranged in two groups. The first of such may be classified as functional flashlights for door lock hardware. The majority of such devices require the illumination source to be manually activated and in some cases deactivated by a mechanical switch. Such devices are described in U.S. Pat. Nos. 4,293,894; 4,310,873; and 4,745,527.

The disadvantage of such devices is that they require one hand to be free for their operation. They therefore do not provide the safety factor of allowing an illumination source to be activated from a distance of several feet from the door. Furthermore, these activation switches create another major disadvantage because they are difficult to locate in the dark. Even further, these devices are obtrusive in nature and mar door surfaces during the installation process.

The second group of devices may be classified as modified door lock assemblies. These devices require existing door lock assemblies to be either retrofitted with illumination hardware or to be replaced with entirely new illuminating door lock hardware. Typical of these assemblies are U.S. Pat. Nos. 4,078,248; 4,777,570; 5,057,975; 5,179,325; and 5,611,226. These assemblies have various ways of activating the illumination source that range from mechanical switches to the use of a piezo electric vibration sensor. However, all of these assemblies require the performance of some physical activity on a door to switch the light source, thereby not providing the extra element of safety of having the illumination source activated prior to reaching the doorway. Furthermore the above assemblies have the obvious disadvantage of having the operator disassemble existing door lock hardware in order to install illumination devices or replace the entire existing hardware at considerable cost and time.

Another class of device is represented by Pfeiffer in U.S. Pat. No. 3,536,836. Pfeiffer teaches adaptive acoustic threshold detection by storing acoustic signal amplitude history as charge within a crystal, capacitive microphone element. However, this technique has limited adaptive range and limited impulse response.

Du Mont in U.S. Pat. No. 1,844,117 discloses a sound operated circuit controller. Furthermore, Praetorius in U.S. Pat. No. 2,015,962 discloses an acoustic switch in which the acoustic sensing is performed mostly by mechanical means. In Du Mont and Praetorius, an electro-mechanical or a mechanical apparatus is employed to switch electrical circuits. In the present invention, sound is detected by a solid state miniature acoustic transducer and switching is performed by solid state electronics.

Laporte in U.S. Pat. No. 2,572,814 discloses a signal light in a telephone shell. Furthermore, Mark in U.S. Pat. No. 4,690,242 discloses a sound activated switch. In Mark the switching arrangements operate in response to particular frequencies of sound thereby discriminating against unwanted sounds for switch activation, whereas the present invention incorporates the use of adaptive acoustic amplitude threshold detection.

Hashimoto in U.S. Statutory Invention Registration #H891 discloses an automatic illumination switching device that responds to specific spoken commands by a particular speaker. The teachings of Hashimoto do not find utility or use in the present invention and is not relevant because the present invention does not respond to select spoken commands and only responds to the magnitude of acoustic inputs that occur above an adaptive, amplitude sensitive threshold.

While these devices fulfill their respective, particular objectives and requirements, the aforementioned patents do not describe an adaptive sound actuated illumination device for battery-operation that allows illuminating an entry door lock in response to a sound. The present invention also substantially departs from conventional mechanical arraignments whereby the present invention illustrates mounting features that provide for an adaptive, universal, non-marring mounting flange.

In this respect, the adaptive sound actuated illumination device for battery operation according to the present invention substantially departs from the conventional concepts and designs depicted in prior art, and in doing so provides an apparatus primarily developed for the purpose of illuminating an entry door lock in response to a sound and incorporating new and unique mechanical mounting features.

Therefore, it can be appreciated that there exists a continuing need for a new and improved adaptive sound actuated illumination device for battery operation with new and improved mechanical mounting features, which can be used for illuminating an entry door lock in response to sound. In this regard, the present invention substantially fulfills this need.

SUMMARY OF THE INVENTION

In view of the foregoing disadvantages inherent in the known types of illumination devices of known designs and configurations now present in the prior art, the present invention provides a new and improved adaptive sound actuated illumination device for battery operation with new and unique mechanical mounting features useful for illuminating entry door lock hardware unlike anything depicted in prior art.

As such, the general purpose of the present invention, which will be described subsequently in greater detail, is to provide a new and improved adaptive sound actuated illumination device for battery operation and method which substantially departs from prior art.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

It is therefore the primary object of the present invention to provide an aesthetically pleasing illumination device for door locks, actuated by sound and optimized for outdoor use with ambient noise and light abatement, extended battery powered operation, and an adaptive, universal, non-marring mounting flange for unobtrusive mechanical installation. Such a device provides great utility and safety in aiding in the process of finding the proper key and its insertion in the lock of a door during nighttime entrance of a residence. The new and improved adaptive battery-operated sound actuated illumination device includes a collective combination of sensory circuits that act in concert to provide the performance and functional features and benefits with a housing of durable material having an interior chamber and electronic components located within said chamber.

It is further an object of the present invention to provide an enclosure that is universal in nature and that can be adapted to most all standard door hardware including deadbolt and doorknob lock assemblies. The enclosure utilizes existing door lock hardware to fasten the enclosure to the door, eliminating the need for additional mounting holes in the door. This also alleviates concerns about marring or defacing door finishes during installation or removal of this device.

An even further object of the present invention is to provide an element of safety and convenience for the user so that under dark ambient lighting conditions the door lock hardware location can be easily identified from a distance of a several feet and the process of finding the proper key and the unlocking of door locks be made easily and faster.

Even still it is further an object of the present invention to have the illumination to be activated by acoustic pressure waves induced by the clap of hands or human voice. It is another object of the present invention to reduce the requirement for electrical energy to a minimum, thereby extending the intervals between required battery replacements. Calculations indicate that the battery in the preferred embodiment will need replacement only at 1 to 1½ year intervals. The present invention includes the following electronic design features that combine to reduce the requirement for electrical energy and extend battery life.

An actuation threshold that adapts and dynamically responds to the ambient noise level is used to prevent false trigger activation and extends battery life.

A light sensor and internal design logic turns off the sound actuator, even in the event of an acoustic input, and shuts down the illuminator when ambient illumination is bright enough that additional light is unnecessary, for example in daylight hours, thereby extending battery life.

A time delay circuit turns off the illuminator after a preset time interval as a feature of convenience to the user and to extend battery life.

A constant current circuit provides a fixed and controlled current through the illuminator, providing more uniform utilization of the battery life when the battery is fresh, and continued constant brightness as the battery voltage decreases with use and age thereby extending battery life.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and further objects other than those set forth above will become apparent when consideration is given to the following detailed description thereof. Such description makes reference to the annexed drawings wherein.

The same reference numerals refer to the same parts throughout the various Figures.

DETAILED DESCRIPTION OF THE PREFERRED EMBODIMENT

Figure 1:
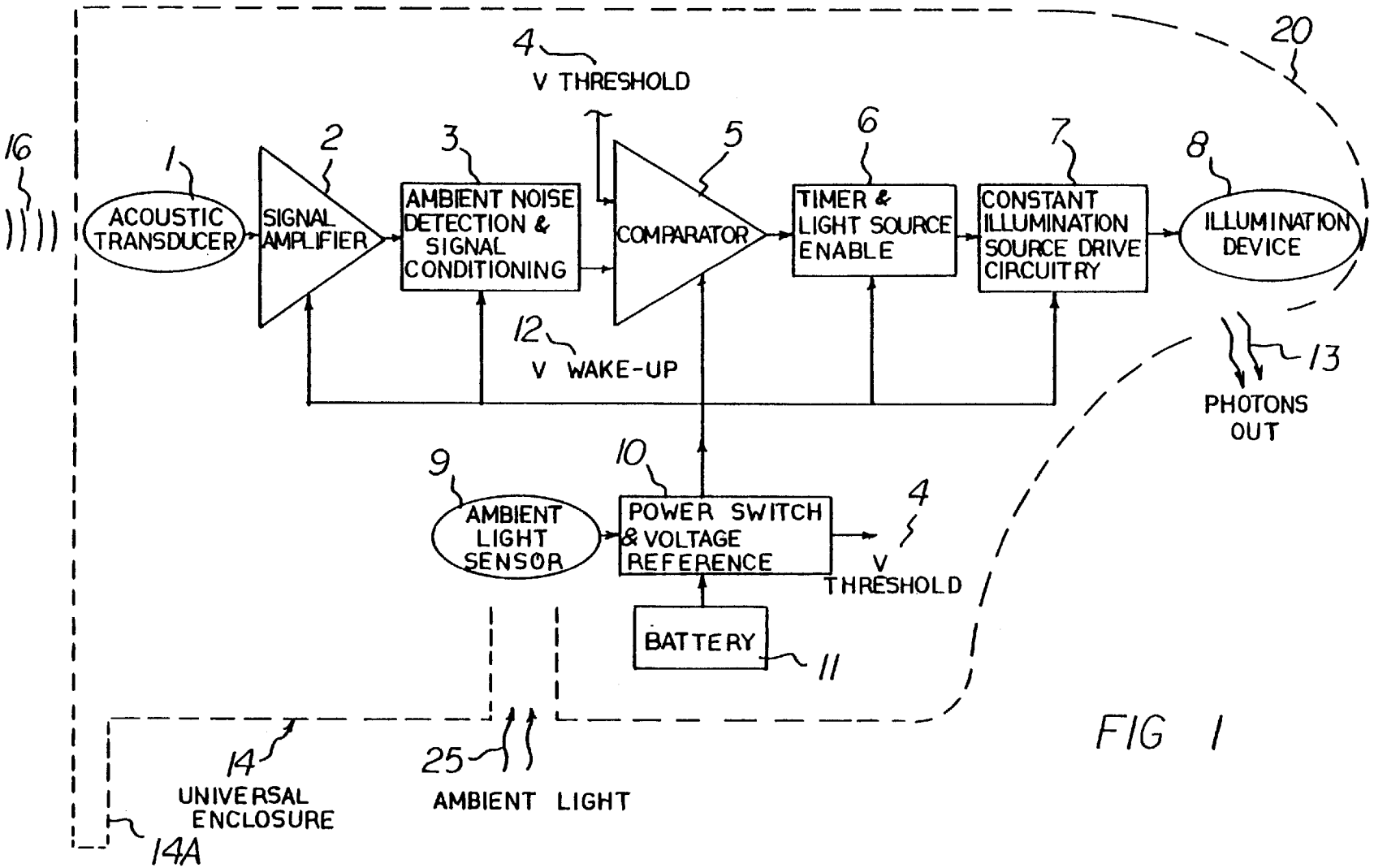
FIG. 1 is a functional block diagram of the preferred embodiment of the invention.

With reference now to the drawings, and in particular to FIGS. 1 through 5B thereof, the preferred embodiment of the new and improved adaptive battery-operated sound actuated illumination device embodying the principles and concepts of the present invention and generally designated by the reference numeral 20 will be described.

The present invention, the adaptive battery-operated sound actuated illumination device 20 is comprised of a plurality of components. Such components in their broadest context include a housing and electrical components. Such components are individually configured and correlated with respect to each other so as to attain the desired objectives.

Figure 2:
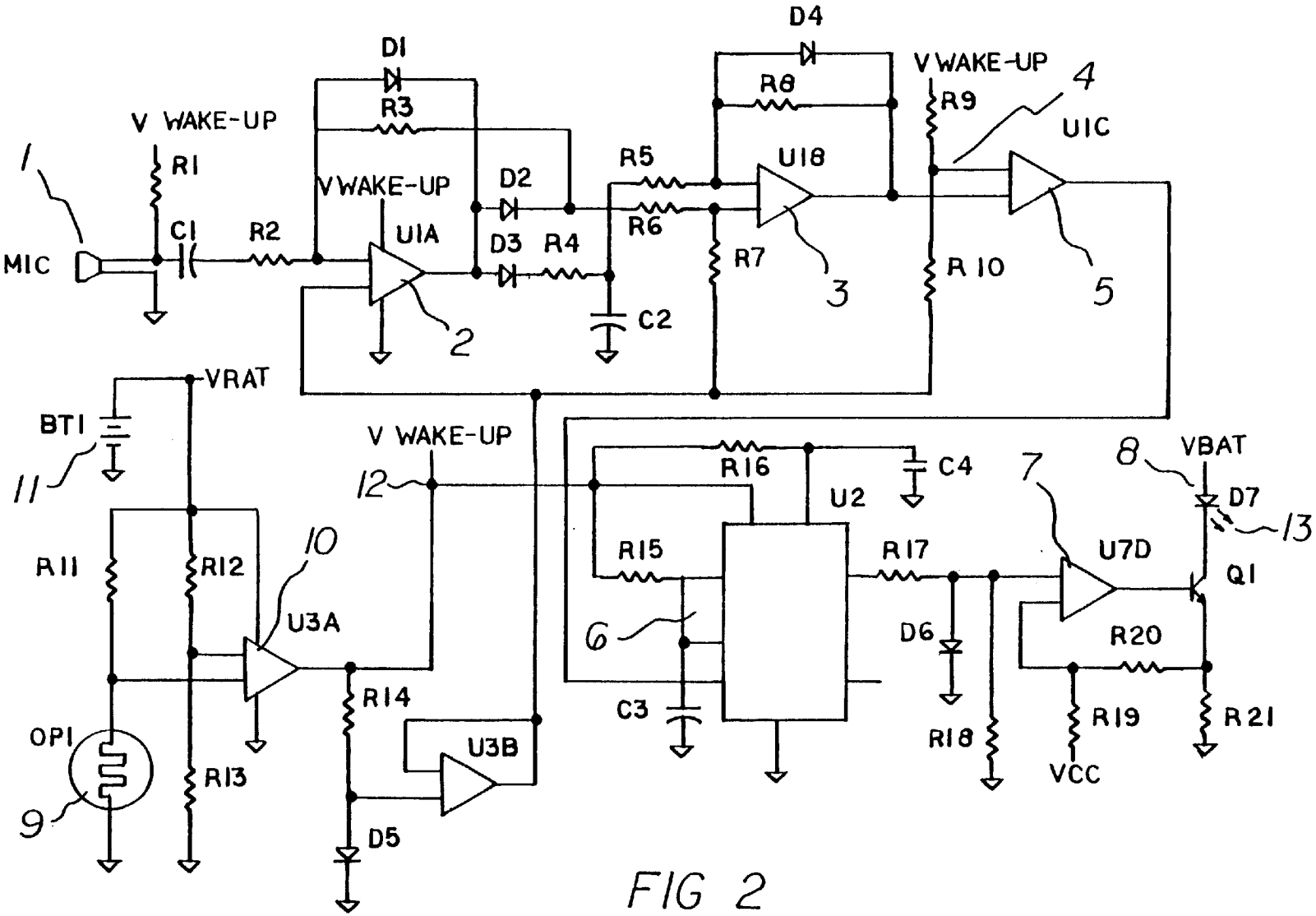
FIG. 2 is an electrical schematic of the electrical circuits of the invention.

With reference to FIG. 1, a functional block diagram of the FIG. 2 circuit schematic, the invention includes an adaptive battery-operated sound actuated illumination device for entry door lock assemblies comprising of an acoustic transducer 1 for receiving sound energy 16. Next included is a signal amplifier 2 for receiving the output signal of the acoustic transducer and amplifying its signal. Also including an ambient noise detection and signal conditioning component 3 for receiving the output signal from the signal amplifier and sample ambient sound and allowing only sharp sounds such as the clap of hands to trigger the comparator. Further including a V-threshold line 4 between the power switch and voltage reference stage 10 and comparator 5 which determines what level of sound is required to make the comparator change states. Even further comprising a comparator 5 for receiving an output signal of the ambient noise detection and signal-conditioning stage. The comparator will change states when sufficient sound energy exceeds the sampled ambient sound. Further including a timer and light source enable stage 6 for receiving an output signal from the comparator and providing 30 to 60 seconds of illumination. Further including a constant illumination source drive circuitry 7 for receiving an output signal from the timer and light source enable.

Further including an illumination device 8 for receiving an output signal from the constant illumination source drive circuitry. The illumination device, when enabled, will then provide photons out 13 that are directed and aimed by the universal enclosure 14 with its interior chamber so as to provide illumination for the deadbolt lock assembly 17A and key 18 and allows the entire unit 20 to be installed onto doors with most any type of door lock assemblies with the adaptive universal, non-marring mounting flange 14A.

To sense whether it is day or night an ambient light sensor 9 that samples ambient light 25 is provided. The output of the light sensor 9 then feeds the power switch and voltage reference stage 10 which will provide power to all of the above components during the night and shuts down power during the day.

Further including a battery 11 which sources power to the power switch and voltage reference stage 10. Further including a V wake-up line 12 connecting between the power switch and voltage reference stage 10 to signal amplifier 2, to ambient noise detection and signal conditioning 3, to comparator 5, to timer and light source enable stage 6, and to illumination source drive circuitry 7. When the ambient light sensor 9 senses sufficient ambient light from any kind of source, the V wake-up line 12 will be disabled and will remain in a low state until an absence of ambient light occurs, thereby enabling the V wake-up line 12 to a high state.

Reference is now made to FIG. 2, the electrical schematic, which illustrates the ambient light sensor 9 and power switch and voltage reference stage 10. Sensor OP1, U3A and associated components form the ambient light sensor and power switch. OP1 is a light sensor. In the preferred embodiment, OP1 is a photocell, the resistance of which decreases with increasing light level. The packaging of the invention is such that ambient illumination is applied to OP1. U3A is an operational amplifier used as a comparator and power switch. The current used by the rest of the circuit is very low and well within the output current capabilities of U3A. Resistor R12 and R13 provide a voltage at the negative input of U3A, pin 2 of the comparator. The voltage at pin 2 sets the desired threshold for ambient light. Resistor R11 and OP1 provide a voltage (proportional to the actual light level) to the non-inverting input of U3A, pin 3. When ambient illumination is high, the voltage at pin 3 is below that of pin 2. Consequently, the output (called V wake-up) of the comparator/switch U3A is at 0 Volts and the rest of the circuitry is turned off.

When ambient illumination decreases, the resistance of OP1 rises, also increasing the voltage at U3A, pin 3. As the ambient illumination falls, eventually the voltage at U3A, pin 3 will rise above the voltage at U3A, pin 2, thereby causing the U3A, pin 1 to switch to the ON state, providing power to the balance of the circuit and activating all other functions.

Resistor R14, diode D5 and operational amplifier U3B form a reference voltage source, a subset of the voltage reference stage 10. Resistor R14 sets a current through forward-biased diode D5, which provides a constant voltage of 0.4 V to the non-inverting input of U3B, pin 5, which is configured as a voltage follower. This reference voltage is applied to the sound sensor, adaptive acoustic threshold circuit and actuation detector circuit. Together with Diodes D1 and D4, this voltage prevents U1A and U1B from saturating and reducing their frequency response.

The sound sensor acoustic transducer 1 consists of the electric condenser microphone element, X1, operational amplifier U1A and associated components.

The packaging of the invention ensures X1 has access to the acoustic environment. When V wake-up is high, X1 responds to sound with a small AC voltage proportional to the sound amplitude. U1A is configured as a precision half-wave rectifier using D1 and D2, with an amplifier stage with a gain set by resistors R2 and R3. U1A amplifies a voltage proportional to sound from X1 to a usable level, and discards the negative voltage peaks via half-wave rectification.

The ambient noise detection and signal conditioning unit 3 uses an adaptive acoustic threshold. Op-Amp U1B, U1C, diode D3, capacitor C2 and associated components form the adaptive acoustic threshold circuit. A voltage proportional to an average of the positive-going pulses from the sound sensor is stored on C2. This voltage represents the average amplitude level of the ambient acoustic noise. If ambient noise amplitude level is low, the voltage on C2 will also be low, and vice-versa.

Op-Amp U1B is set up as a differential amplifier with unbalanced negative and positive gain. Normally its output is low, since the ambient noise voltage will tend to dominate.

A voltage spike for instance from a handclap or sharply spoken word that is significantly louder than the ambient noise voltage will be amplified by U1B in a positive direction. The out of U1B, pin 7 and comparator U1C pin 9 input, will rise above the voltage at U1C, pin 10. The voltage at U1C, pin 10 is set by V wake-up, R9, R10 and the reference voltage. Then the comparator output will go low, signifying that the illumination source should be turned on.

When the ambient acoustic noise decreases, the voltage at the anode of diode D3 will be less than that stored on C2. No additional voltage will be stored. Voltage representing ambient acoustic noise will decay toward zero volts through R4 and R5. Eventually, the incoming and outgoing charge will balance and the voltage will remain constant. In other words, the ambient noise threshold will follow the ambient noise, with some delay for averaging over time.

The timer and light source enable stage 6 uses an Op-amp U2 and associated components comprise the illumination switch with a timed delayed turn-off. U2 is a low power timer integrated circuit, set up as a monostable multivibrator. Resistor R15 and capacitor C3 are the timing components. A negative-going pulse from the output of comparator op-amp U1C, pin 8 triggers the input of U2 pin 2. The output of U2, pin 3 will remain high for a time period set by resistor R15 and capacitor C3. The period can be calculated by $T=1.1\times R15\times C3$. In the preferred embodiment, this period is between 20 and 60 seconds, preferably about 30 seconds. The illumination source will remain lighted for the period that the output of the monostable multivibrator is high.

The constant illumination source drive circuitry 7 employs an operational amplifier U1D, transistor Q1, rectifier diode D6, LED D7 and associated circuitry and comprises the illumination source and constant current generator. The monostable multivibrator output voltage at U2 pin 3 is zero volts (low). Therefore, the operational amplifier input (U1D pin 12) also will have zero volts applied. The operational amplifier attempts to maintain the inverting input of U1D, pin 13 at the same potential of U1D, the non-inverting input pin 12. The feedback consisting of U1D, Q1, and resistor R21 will cause the voltage at U1D, pin 12 to be impressed across R21. The impressed voltage of zero across R21 will then cause a zero current to flow through R21 and the emitter of Q1. The collector current of Q1 and LED D7 is zero and the LED off resulting in no illumination output.

When the monostable multivibrator output U2, pin 3 is high, a current will flow through R17 and diode D6. The current through D6 will cause a forward voltage drop to appear at the anode of D6 and U1D, pin 12. The 0.4 volts at the anode of D6 and input of U1D, pin 12 will remain approximately constant as the battery voltage falls during discharge. The operational amplifier U1D will cause Q1 to conduct just enough to maintain constant current through the emitter of Q1, the collector of Q1, and LED D7. The impressed voltage of 0.4 volts across R21 will then cause a controlled current of 14.8 mA to flow through R21 and the emitter of Q1. The collector current of Q1 which is very nearly equal to the emitter current of Q1, and equal to 14.8 mA, also flows through the LED D7. Current through the LED D7 causes visible photons 13 to be emitted from LED D7 thus illuminating door lock assemblies.

This circuit configuration is known as a constant current source and provides a fixed current through the illuminator, LED D7 which results in constant brightness as the battery voltage decreases over the life of the battery.

Figure 3A:
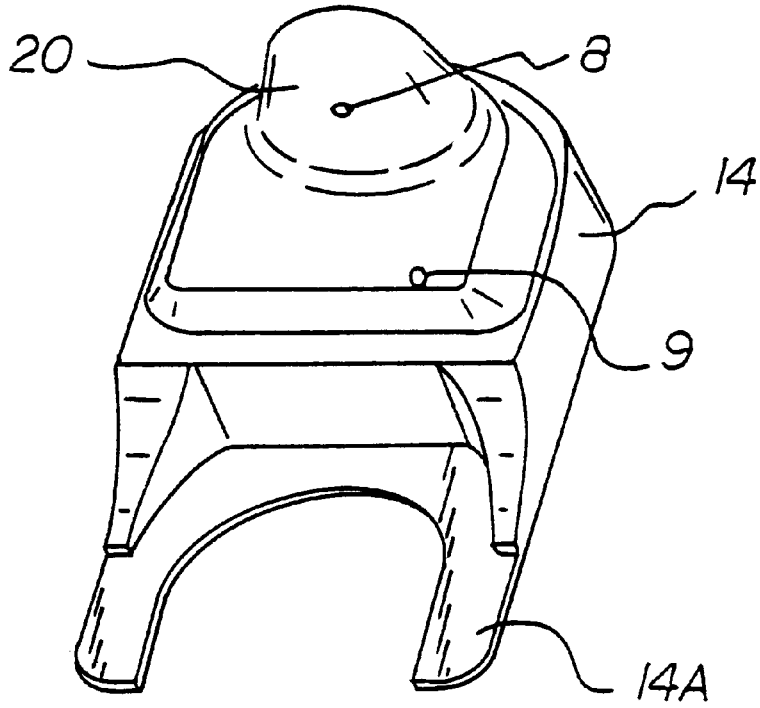
FIG. 3A is a perspective drawing of the said invention depicting the unique mechanical structure and shape.
Figure 3B:
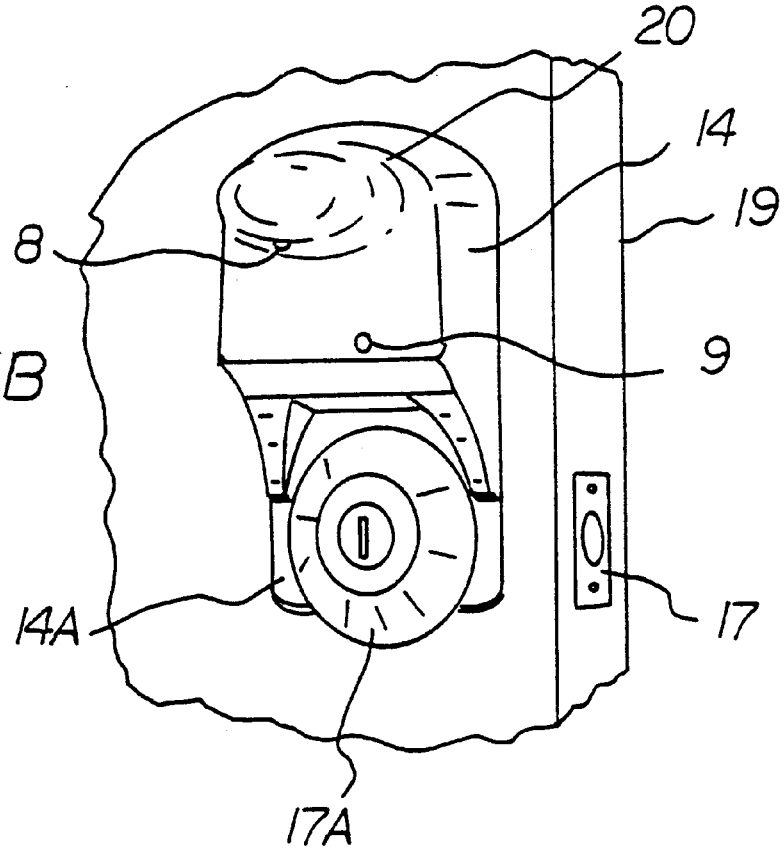
FIG. 3B is a drawing depicting the said invention installed on the exterior portion of a door utilizing a deadbolt lock assembly.
Figure 4A:
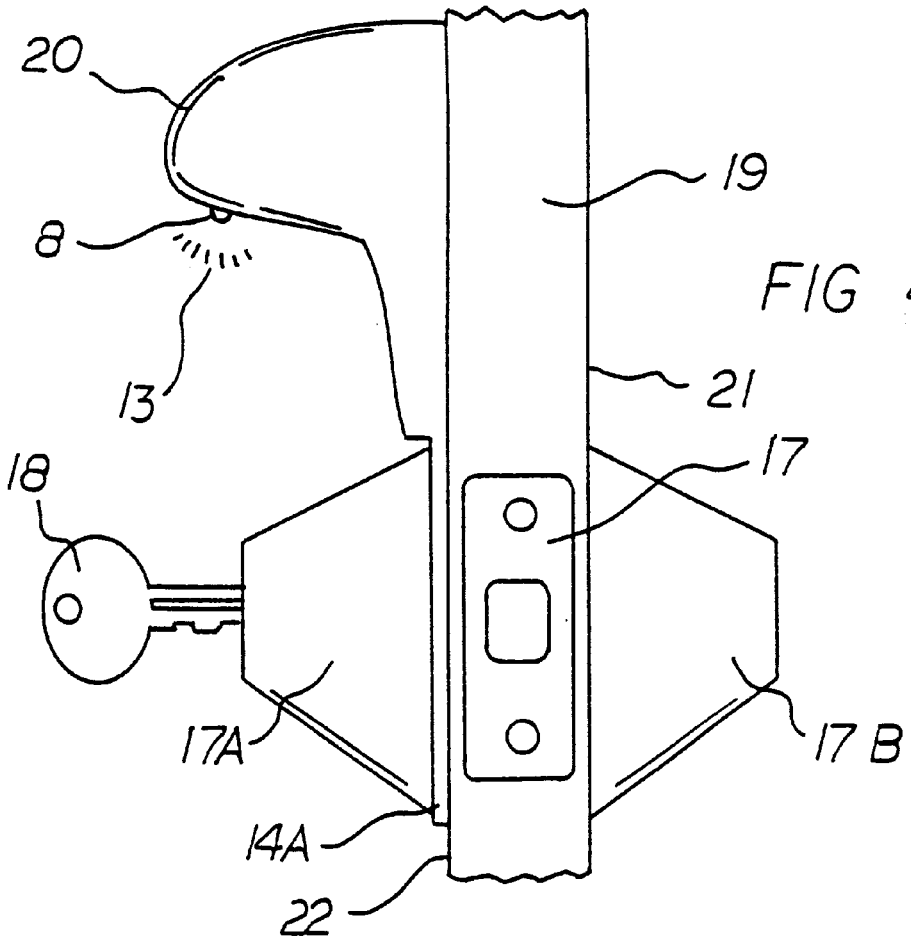
FIG. 4A is the side view of the said invention installed onto the exterior portion of a door utilizing a deadbolt lock assembly.
Figure 4B:
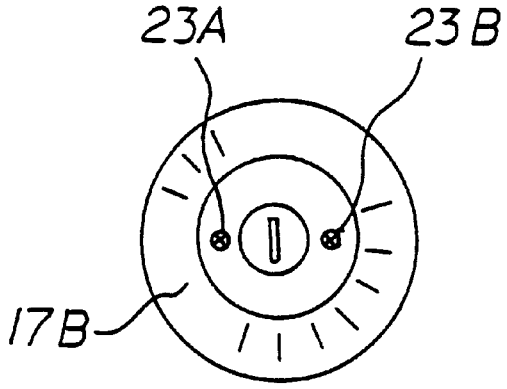
FIG. 4B is a front view of the interior portion of the deadbolt lock assembly.

Reference is now made to FIGS. 3A, 3B, 4A, 4B, 5A and 5B for the following detailed mechanical description. Most door lock hardware installation is standard in nature and will allow the invention 20 to be installed swiftly and with great ease. No drilling of additional holes for screws or the use of adhesive of any kind is required to secure the invention 20 to a door 19. The great advantage is no marring of the surface of the door during the installation or removal of the invention. FIG. 3A is a perspective view of the invention 20 and depicts the adaptive universal non-marring mounting flange 14A which has a horseshoe-shaped aperture that matches the standard aperture in the door for doorknob locks or deadbolt lock assemblies. FIG. 3B depicts the invention 20 mounted to a door utilizing a deadbolt lock assembly 17A. FIG. 4A is the side view of the said invention 20 installed on to the exterior side 22 of a door 19 utilizing a deadbolt lock assembly 17A, 17B and 17 respectively. Also depicted are key 18, and the exterior portion of the deadbolt lock 17A being illuminated by photons 13, which are emitted by the illumination source 8. FIG. 4B depicts the front view of a deadbolt lock 17B and the two mounting screws 23A, 23B as it appears on the interior surface 21 of the door 19.

The invention 20 is installed utilizing a deadbolt lock assembly when the two screws 23A, 23B are loosened just enough to allow a sufficient gap between the exterior portion of the lock 17A and the exterior surface 22 of the door 19. The adaptive universal non-marring mounting flange 14A of the invention is placed between the lock 17A and the exterior door surface 22. The aperture within the mounting flange 14A allows clearance for screws 23A, 23B and associated lock hardware that is attached between 17A, 17 and 17B. The invention is then secured to the door by tightening the two screws 23A, 23B and is now effectively clamped to the door by the door lock assembly 17A, 17B.

Figure 5A:
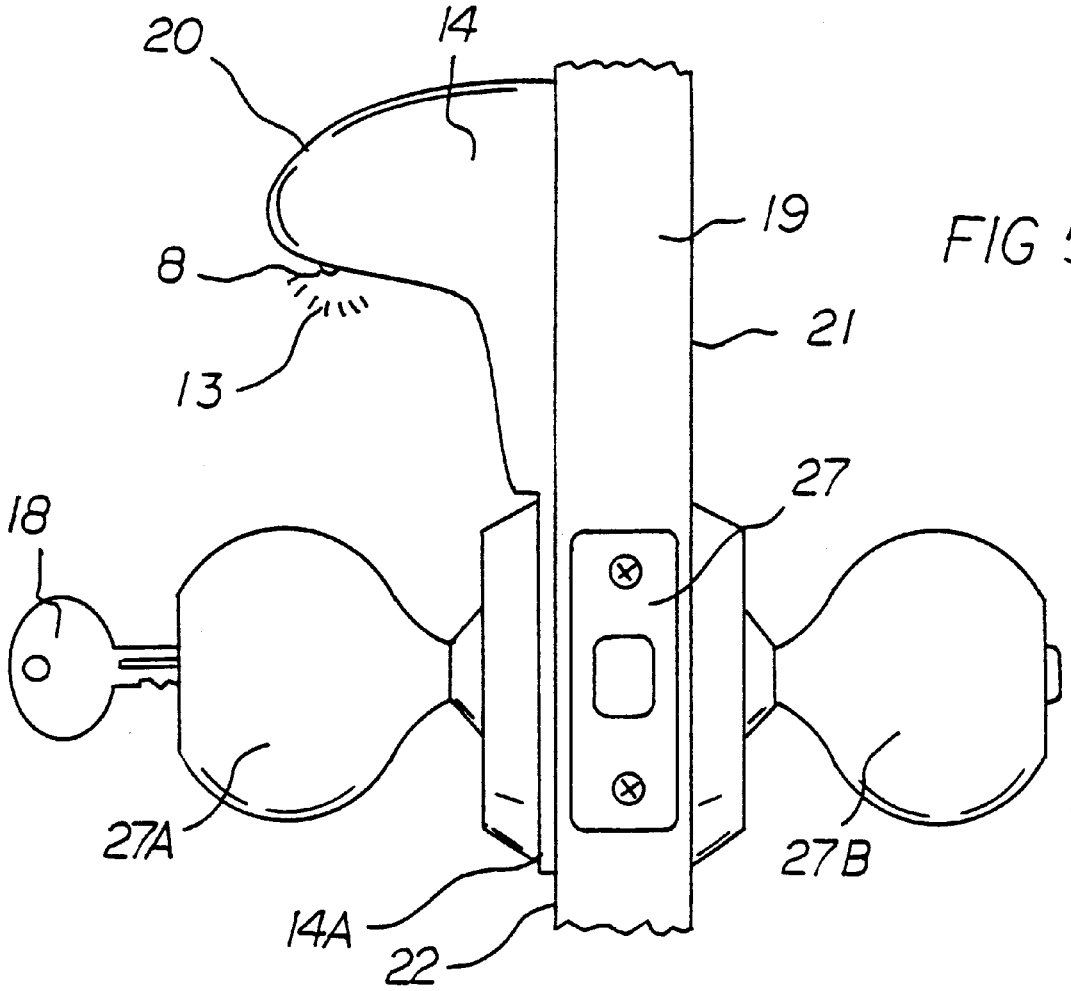
FIG. 5A is the side view of the said invention installed onto the exterior portion of a door utilizing a doorknob lock assembly.
Figure 5B:
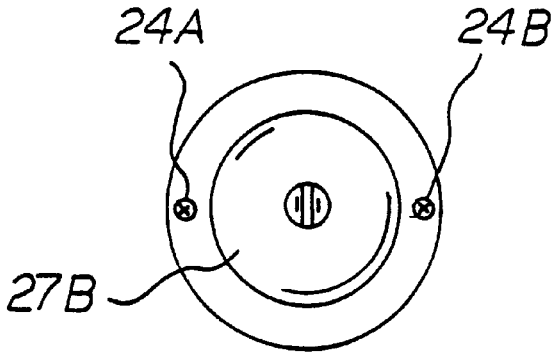
FIG. 5B is a front view of the interior portion of the doorknob lock assembly.

FIGS. 5A and 5B depict the installation of said invention using doorknob lock assembly 27, 27A, and 27B. The two screws 24A, 24B are loosened just enough to allow a sufficient gap between the exterior portion of the doorknob 27A and the exterior surface 22 of the door 19. The adaptive universal non-marring mounting flange 14A of the invention is then slipped between the lock 27A and the exterior door surface 22. The invention is then secured to the door by tightening the two screws 24A, 24B and is now effectively clamped to the door by the door knob lock assembly 27A, 27B. Also depicted are key 18, and the exterior portion of the doorknob lock 27A being illuminated by photons 13, which are emitted by the illumination source 8.

In the case where both a deadbolt lock assembly and a doorknob lock assembly are used on the same door, the device would be mounted to the top most assembly. The invention then provides illumination for both the deadbolt and doorknob lock assemblies.

Figure 6:
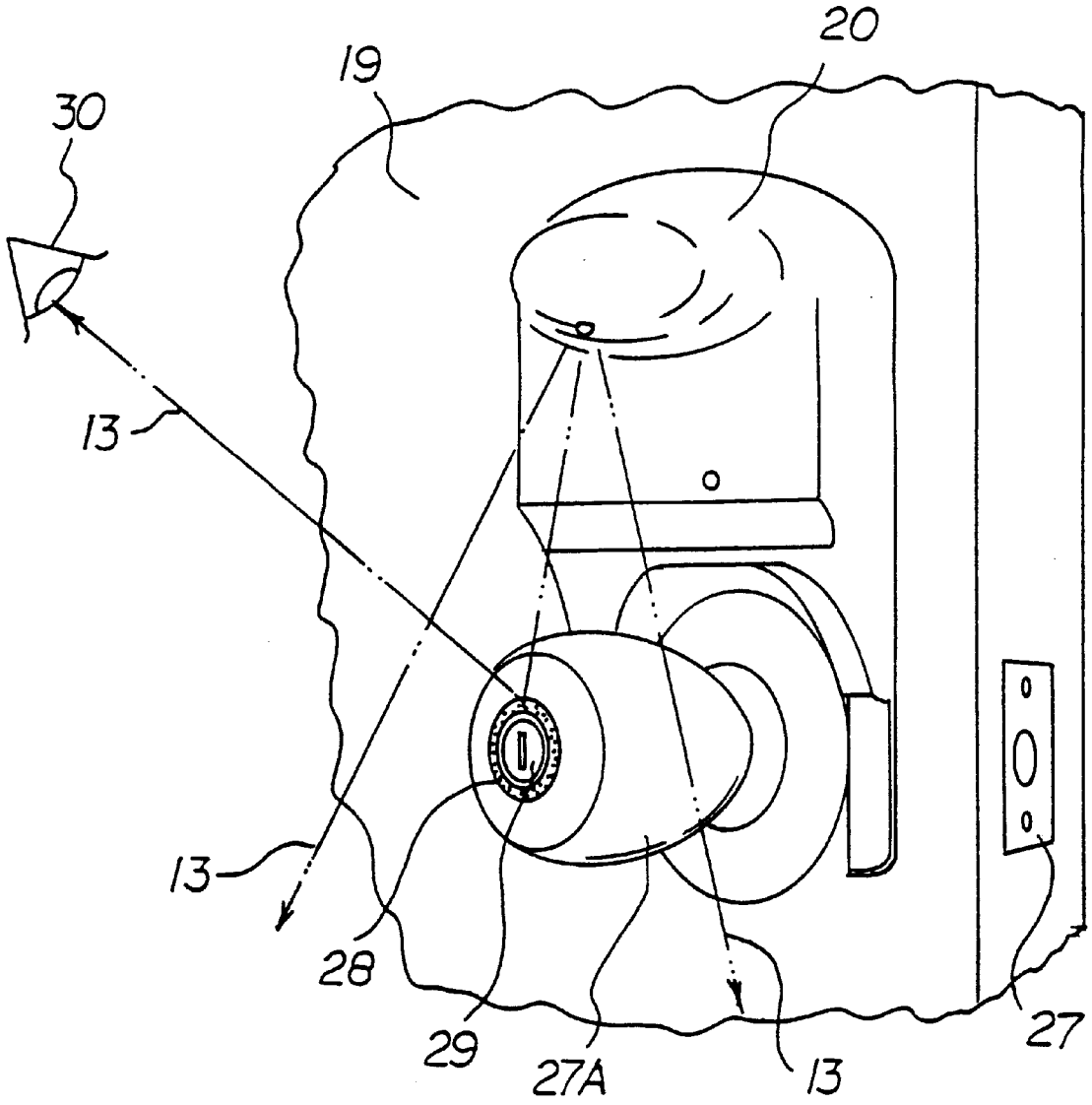
FIG. 6 depicts the front view of the exterior portions of a doorknob lock assembly installed with an alternate illumination enhancement device.

Reference is now made to FIG. 6 for the following illumination enhancement device description, an alternate embodiment of the invention. In FIG. 6, an illumination enhancement device 28 is included with the invention 20 as an option. This device comprises a reflective, phosphorescent, or fluorescent material with self-adhesive "peel and stick" properties that adhere to a doorknob 27A. Even though it is not illustrated in FIG. 6, the same illumination enhancement device may be attached to deadbolt lock assemblies as well. The said illumination enhancement device 28 consists of a durable but pliable substance fashioned as a ring with an aperture that clears the key-way area 29 of a doorknob or deadbolt lock assembly.

The illumination enhancement device 28 is provided to the user 30 as an option for applications where certain styles of door lock assemblies may inhibit a certain amount of emitted light from invention 20 to be reflected as usable light for the user 30. The illumination enhancement device collects photons 13 that are emitted from invention 20 and then either redirects photons 13 back to the cone of vision of the user 30 by reflection and/or creates new photons by phosphorescence or fluorescence. The ring of reflected or newly emitted photons that surrounds the key-way area 29 then appear to the user 30 as a target for easy key insertion.

A high-brightness light-emitting diode (LED) is used in the preferred embodiment. LEDs are inexpensive and provide more light per unit of energy consumed than an incandescent lamp. However, an alternate embodiment would include an electrolumenescent lamp or a fluorescent lamp that is also energy-efficient. In these cases, the constant illumination source drive circuitry 7 would simply be replaced with well-known invertor circuitry. The use of an incandescent lamp is also another alternate source of illumination that can be adapted to the present invention.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

What is claimed is:

1. A new and improved illumination system for door locks and keyholes to effect the illumination of a door lock assembly upon the making of a noise by a user comprising, in combination;

an enclosure having an adaptive non-marring region with an aperture and flange positioned between the door and the exterior portion of the deadbolt lock, within this enclosure of durable material having an interior chamber consisting of electronic components located within the chamber, the electrical components including a light emitting diode positioned within the housing adjacent to the exterior portion of the deadbolt lock or door knob lock, a sound receiving microphone adapted to be energized in response to a noise by the user to energize the light emitting diode, an optical sensor adapted to determine the existence of ambient light to thereby preclude the illumination of the light emitting diode when sufficient light is detected, an electronic circuit to receive the inputs of the microphone and optical sensor and to provide an output to energize the light emitting diode, a time sensing electrical component including a resistor, capacitor and an integrated circuit to time out the activation of the light emitting diode after a predetermined period of time between, but not limited to, 20 and 60 seconds, and a battery to power the electrical components.

2. A system to effect illumination comprising:

a housing of durable material having an interior chamber; and electrical components located within the chamber, the electrical components including an illumination device positioned within the housing adjacent to an area to be illuminated, a sound receiving microphone adapted to be energized in response to a noise by the user to energize the illumination device, an optical sensor adapted to determine the existence of ambient light to thereby preclude the illumination of the illumination device when sufficient light is detected, an integrated circuit to receive the inputs of the microphone and optical sensor and to provide an output to energize the illumination device, a time sensing electrical component adjacent to the input end of the integrated circuit to time out the activation of the light emitting diode after a predetermined period and a power source to power the sound sensor, optical sensor, timing circuit, and light emitting diode.

3. The system as set forth in claim 2 wherein the housing is coupled in proximity to a door lock assembly of a door.

4. The system as set forth in claim 2 wherein the time out is set but not limited to be between 20 and 60 seconds.

5. The system as set forth in claim 2 wherein the power source is a battery.

6. An adaptive, battery operated, sound actuated illumination device for entry door lock assemblies comprising:

an acoustic transducer for receiving sound energy;

a signal amplifier for receiving the output signal of the acoustic transducer;

an ambient noise detection and signal conditioning component for receiving the output signal from the signal amplifier;

a comparator for receiving an output signal of the ambient noise detection and signal conditioning component;

an ambient light sensor;

a power switch and voltage reference component for receiving an output signal from the ambient light sensor;

a timer and light source enable component for receiving an output signal from the comparator, the power switch and voltage reference, and the ambient noise detection and signal conditioning component;

an illumination source drive circuitry for receiving an output signal from the comparator and the timer and light source enable;

a battery adapted to the power switch and voltage reference to be disabled upon the activation of the power switch and voltage reference;

an illumination device for receiving an output signal from the illumination source drive circuitry powered by the battery when the illumination device is enabled by the power switch and voltage reference, whereby photons are emitted from the illumination device upon the activation thereof;

an enclosure having a universal adaptive non-marring region with an aperture and flange positioned between the door and the exterior portion of the deadbolt lock; and an optional illumination enhancement device used to collect emitted photons from the LED light source to redirect or generate new photons.

* * * * *